US007685786B2

(12) United States Patent
Cousin

(10) Patent No.: US 7,685,786 B2
(45) Date of Patent: Mar. 30, 2010

(54) FABRIC SUPPORT FRAME SECTION

(76) Inventor: Etienne Cousin, 79 rue Auguste Potie, 59320 Haubourdin (FR)

( * ) Notice: Subject to any disclaimer, the term of this patent is extended or adjusted under 35 U.S.C. 154(b) by 134 days.

(21) Appl. No.: 11/592,355

(22) Filed: Nov. 3, 2006

(65) Prior Publication Data

US 2007/0157535 A1 Jul. 12, 2007

(30) Foreign Application Priority Data

Nov. 3, 2005 (FR) ..... 05 11199

(51) Int. Cl.
*E04B 2/00* (2006.01)
*E04B 1/38* (2006.01)
*E04B 7/00* (2006.01)

(52) U.S. Cl. ..... 52/506.06; 52/506.07; 52/506.03; 52/511; 52/22

(58) Field of Classification Search ..... 52/506.06, 52/506.07, 506.03, 511, 507, 484, 633, 22; 362/150, 217, 290
See application file for complete search history.

(56) References Cited

U.S. PATENT DOCUMENTS

| | | | | | |
|---|---|---|---|---|---|
| 2,029,441 | A | * | 2/1936 | Parkinson | 181/30 |
| 2,802,764 | A | * | 8/1957 | Games et al. | 181/291 |
| 3,205,628 | A | * | 9/1965 | Frisk | 52/222 |
| 3,546,842 | A | * | 12/1970 | Blum | 52/506.07 |
| 3,914,887 | A | * | 10/1975 | Newman | 38/102.8 |
| 3,950,869 | A | * | 4/1976 | Samarin | 38/102.91 |
| 4,083,157 | A | * | 4/1978 | Anthonioz | 52/222 |
| 4,301,853 | A | * | 11/1981 | Vidal | 160/374.1 |
| 4,408,433 | A | * | 10/1983 | Scherrer | 52/506.06 |
| 4,711,060 | A | * | 12/1987 | Scherrer | 52/222 |
| 4,901,485 | A | * | 2/1990 | Menchetti et al. | 52/145 |
| 5,058,340 | A | * | 10/1991 | Muller | 52/222 |
| 5,226,720 | A | * | 7/1993 | Caferro | 362/150 |
| 5,517,775 | A | * | 5/1996 | Kurtz | 38/102.91 |
| 5,809,730 | A | * | 9/1998 | Renz | 52/506.09 |
| 5,918,392 | A | * | 7/1999 | Bates | 38/102.1 |
| 5,937,605 | A | * | 8/1999 | Wendt | 52/506.06 |
| 5,970,669 | A | * | 10/1999 | Livingston | 52/222 |
| 6,053,558 | A | * | 4/2000 | Weldy et al. | 296/100.17 |
| 6,327,828 | B1 | * | 12/2001 | Carroll | 52/480 |
| 6,477,815 | B2 | * | 11/2002 | Paul et al. | 52/506.06 |
| 6,499,262 | B1 | * | 12/2002 | Pinchot et al. | 52/273 |
| 6,523,314 | B1 | * | 2/2003 | LaLonde et al. | 52/506.07 |
| 2004/0172907 | A1 | * | 9/2004 | Krantz-Lilienthal et al. | 52/506.05 |

FOREIGN PATENT DOCUMENTS

| | | | |
|---|---|---|---|
| FR | 2597906 | * | 4/1986 |
| FR | 2712325 | A1 | 5/1995 |
| FR | 2751682 | A1 | 1/1998 |
| FR | 2789101 | A1 | 8/2000 |
| FR | 2793504 | A1 | 11/2000 |
| FR | 2793506 | A1 | 11/2000 |
| FR | 2814482 | A1 | 3/2002 |

* cited by examiner

*Primary Examiner*—Richard E Chilcot, Jr.
*Assistant Examiner*—Mark R Wendell
(74) *Attorney, Agent, or Firm*—Ladas & Parry LLP

(57) ABSTRACT

A false ceiling panel frame, at least one side of this frame including, when viewed in cross section, a top wall and a side wall. The side wall includes an approximately vertical top section and a bottom section, the top section and the bottom section forming an angle in the external face of the panel frame.

12 Claims, 1 Drawing Sheet

FABRIC SUPPORT FRAME SECTION

BACKGROUND OF THE INVENTION

The invention relates to the technical field of suspended false ceilings and false walls.

The invention concerns more specifically false ceiling or false wall panels comprising a stretched fabric and a frame.

Different designs for such false ceiling panels are already known in the prior art.

According to the conventional method, the fabric is made of polyvinyl chloride and is firstly tensioned before being fixed to the frame, this frame being itself previously obtained by assembling aluminum sections.

A major difficulty in producing these panels is that the frame deforms due to fixing under tension of the fabric on the frame.

Various solutions have been proposed in the prior art for overcoming this problem.

Provision of means of applying prestress directed from the interior to the exterior of the frame has been proposed. For example, document FR 2 712 325 of the applicant or documents FR 2 751 682 and FR 2 814 482 can be referred to.

Frame sections provided with reinforcing flanges have also been proposed. Documents FR 2 793 504, FR 2 793 506 and FR 2 789 101 can be referred to in particular. These three previous documents provided by the same applicant Scherrer and prompted by the same technical problem, describe three contradictory and contrasting embodiments.

In a first embodiment described by document FR 2 793 504, the aluminum section comprises two flanges, namely a vertical external flange, on which the polyvinyl chloride fabric is fixed, and a vertical internal flange, whose base is set back from the base of the external flange such that it does not come into contact with the fabric.

In a second embodiment described by document FR 2 793 506, the aluminum section comprises two flanges, namely a vertical external flange, on which the polyvinyl chloride fabric is fixed, and a vertical or inclined internal flange, whose base is located below the base of the external flange such that it comes into contact with the fabric.

In a third embodiment described by document FR 2 789 101, the aluminum section comprises a horizontal top wall, a vertical side wall and an oblique stiffening wall, the section forming a box.

In each of the three assemblies described by documents FR 2 793 504, FR 2 793 506 and FR 2 789 101, the fabric is fixed, in particular by gluing, to the transverse edge of a flange of the section and the width of this fixing edge is shown as very small. No numerical value is given, even as an example, for this fabric fixing edge width.

The alleged advantage of this "small width" of fixing band is as follows: when the panel is set on an inverted T-shaped supporting member fixed to a ceiling by ties, the fabric gluing area on the frame is fully concealed from the view of an observer looking at the false ceiling because the width of the transverse band of the T-shaped section is greater than the width of the fabric gluing area on its frame.

The panels described in documents FR 2 793 504, FR 2 793 506 and FR 2 789 101 have many disadvantages.

Firstly, when the panels have large areas, for example of the order of one square meter, high fabric tension can invariably cause deformation of the frame, on which the fabric is glued.

Secondly, the T-shaped members supporting the panels should preferably be as unobtrusive as possible, the width of their transverse branch being as small as possible such that the appearance of the suspended false ceiling is as similar as possible to that of a true ceiling. The assemblies described in documents FR 2 793 504, FR 2 793 506 and FR 2 789 101 do not allow significant reduction in the width of the T-shaped supporting members, especially when the panels have a large area, except when the fabric gluing area is exposed. The larger the panel area, the larger the fabric gluing area required on the frame, concealment of this gluing area by the T-shaped support being impossible, unless the width of this T-shaped section is increased.

The panel described in document FR 2 793 506 has the following additional disadvantage: the false ceiling finish cannot be close to that of a conventional flat ceiling because the fabric of each panel is not stretched flat onto its frame.

The invention is intended to overcome the problems referred to above.

To this end, according to a first aspect, the invention relates to a false ceiling panel frame, at least one side of this frame comprising, when viewed in cross section, a top wall and a side wall, the side wall including an approximately vertical top section and a bottom section, the top section and bottom section forming an obtuse angle in the external face of the panel frame.

The bottom free edge of the side wall, of adjustable thickness, thereby forms a bearing area for the false ceiling panel, the embodiment of the obtuse angle ensuring greater rigidity with respect to deformation of the frame, when fixing the stretched fabric.

Advantageously, at least one side of the frame includes, when viewed in cross section, at least one approximately horizontal, narrow supporting wall in the bottom end section, in addition to said top wall and side wall. This arrangement allows the profile of conventional false ceiling hangers to be followed, the panel frame being of great height if necessary, for example for installing acoustic or thermal insulation panels on this frame.

In an advantageous embodiment, the width of the supporting wall, the size of the bottom section of the side wall and said obtuse angle are chosen such that the supporting wall extends almost totally towards the exterior of said frame with respect to the vertical plane of said top section of the side wall.

At least one side of this frame includes, when viewed in cross section, at least one stiffening wall in addition to said top wall and side wall such that the deformation strength of the frame is further increased.

Advantageously, said side of the frame includes an assembly slot with its opening facing the interior of the frame. This assembly slot can be used, for example, to place an angle cleat or splice plates for assembling contiguous frame section elements or, again, for installing supporting angles for acoustic and/or thermal insulation panels.

Certain embodiments comprise a first assembly slot extending along a flange internal to the side of the frame, this internal flange being approximately vertical.

Advantageously, the frame comprises a first stiffening wall, this first stiffening wall forming a box with the top wall, the side wall and said internal flange.

Advantageously, said first stiffening wall features at least a second assembly slot, this second assembly slot being suitable for locating a splice plate or an angle cleat for assembling two adjacent sides of the frame.

Advantageously, the frame comprises a second stiffening wall, this second wall forming a box with the first stiffening wall and the side wall. The deformation strength of this frame is therefore remarkably high.

Advantageously, said side of the frame includes, when viewed in cross section, an approximately horizontal top wall, said obtuse angle being between 1 degree and 60 degrees and more especially between 5 degrees and 20 degrees. The width of the approximately horizontal supporting wall is between 1 millimeter and 10 millimeters.

According to a second aspect, the invention relates to false ceiling panels comprising a frame as described above and a fabric, into which the frame is inserted, thereby defining a bottom band of stretched fabric and a top band of stretched fabric.

Such an embodiment offers many advantages. In particular, a person skilled in the art no longer needs to worry that the size of the fabric gluing or welding area on the frame is insufficient for this fixing to resist fabric tensions, this gluing or welding area remaining invisible because it is concealed from view by the T-shaped panel supports.

The panel may comprise an acoustic and/or thermal insulation insert, this insert being installed to bear freely on angles distant from the bottom fabric band.

According to a third aspect, the invention relates to false ceilings comprising a panel as described above, this panel being mounted on an inverted T-shaped support.

BRIEF DESCRIPTION OF THE DRAWING FIGURES

Other objects and advantages of the invention will appear during the following description of embodiments, a description given in reference to the appended drawings, in which.

DETAILED DESCRIPTION OF THE PREFERRED EMBODIMENTS

Figure 1:
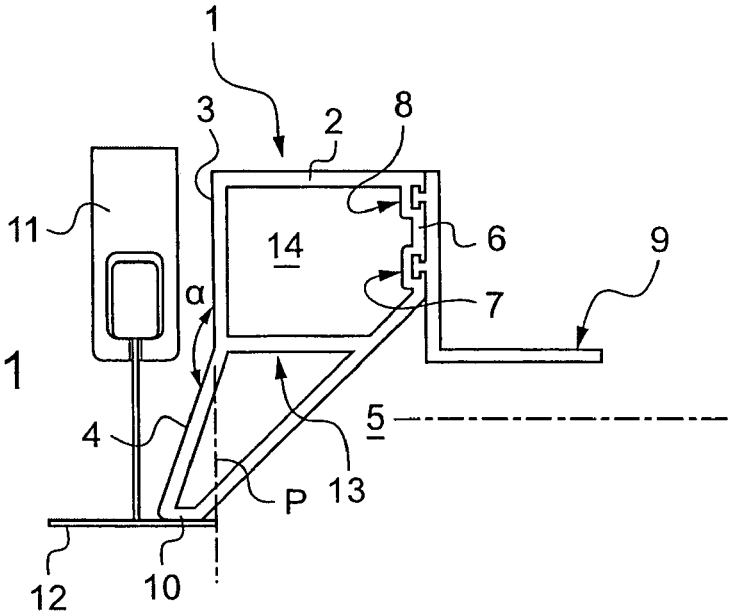
FIG. 1 is a cross-sectional view of a false ceiling panel frame side according to an embodiment.

The panel frame 1 represented in FIG. 1 is, for example, made by extrusion of an aluminum alloy.

This frame 1 comprises an approximately horizontal top wall 2 and a side wall including an approximately vertical top section 3 and an inclined bottom section 4.

The top section 3 and the bottom section 4 define an angle $\alpha$ (alpha) of the order of 10 to 20 degrees, this angle alpha being obtuse, when measured on the external face of the frame. In other words, the bottom section 4 extends away from the interior 5 of the frame 1.

Moreover, the frame includes an approximately vertical internal flange 6 parallel to the top section 3 of the side wall. Two slots 7, 8 with their openings facing the interior 5 of the frame 1 are created in this internal flange 6. If necessary, these slots 7, 8 are used to mount a supporting angle 9 for an insert such as, for example, an acoustic and/or thermal insulation insert or again a lighting device.

The frame 1 also includes a horizontal, narrow bearing surface 10 in the bottom section of the side wall. In the embodiments shown, the bottom section 4 of the side wall, the angle alpha and the width of the horizontal bearing surface 10 are chosen such that this bearing surface 10 extends almost totally towards the exterior of the frame with respect to a vertical plane P corresponding to the top section 3 of the side wall.

This embodiment allows the profile of the supports 11 of the inverted T-shaped bars 12 to be followed as closely as possible.

Furthermore, the frame 1 comprises a first, approximately horizontal, stiffening wall 13. This first stiffening wall forms a box 14 with the top wall 2, the top section 3 of the side wall and the internal flange 6.

Figure 2:
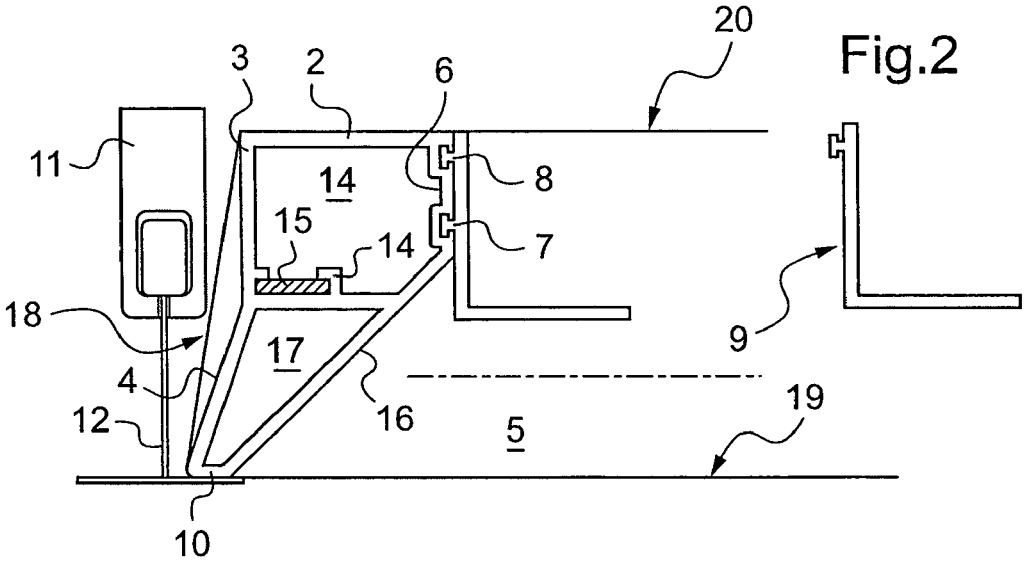
FIG. 2 is a view similar to FIG. 1 of an alternative embodiment, the frame being inserted into a fabric, the insert supporting angle being at a distance from the frame, an assembly angle cleat being in place.

As shown in FIG. 2, a C-shaped slot can be created in this first stiffening wall to locate a splice plate or angle cleat 15 for assembling two contiguous frame sections.

Figure 3:
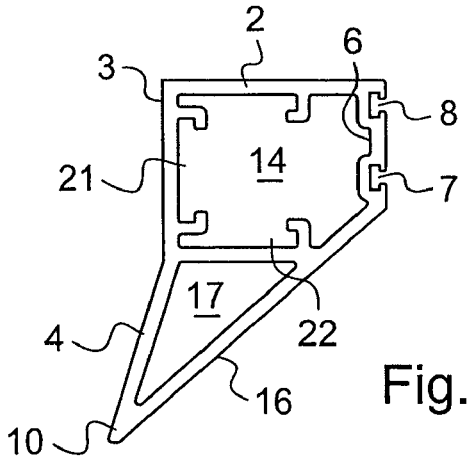
FIG. 3 is a cross-sectional view of a panel frame side according to an alternative embodiment.

In the embodiment represented in FIG. 3, three C-shaped slots extend within the box 14. These three slots 21, 22, 23 extend over the top wall 2, the top section 3 of the side wall and the first stiffening wall. Each of these slots allows splice plates or angle cleats to be installed for assembling contiguous frame sections.

Moreover, the frame 1 comprises a second stiffening wall 16 linking the bearing surface 10 and the internal flange 6. This second stiffening wall forms a box 17 with the side wall, the bearing surface 10 and the first stiffening wall 13.

As shown in FIG. 2, the frame is inserted into a fabric 18 such that a bottom band of fabric 19 and a top band of fabric 20 are defined. For example, the fabric is advantageously thermo-shrunk onto the frame.

These two bands of fabric are approximately parallel in the embodiment represented. Between these two bands 19, 20, acoustic and/or thermal inserts (not shown) can be installed on the angles 9 or any other ad hoc support mounted on the frame 1 in slots 7, 8. The presence of two slots 7, 8 (or more) enables the mounting height of the angles 9 to be adjusted.

For information only, the angle between the horizontal and the stiffening wall 16 is of the order of 40 degrees, the angle between the horizontal and the bottom section 4 of the side wall is 70 degrees, the total height of the frame being between 50 and 100 millimeters.

The materials used for the fabric are advantageously fireproof polymer materials, impervious to air, dust or humidity and easy to maintain.

Translucent or opaque, dope-dyed or not, matt, lacquered, marbled, suede or satin-finish, these materials can therefore be used both in industrial and hospital environments, in community facilities and in laboratories or dwellings. The lacquered finish gives a mirror effect often implemented in shopping malls, a matt finish similar to a plaster aspect being more common to traditional decors.

The invention claimed is:

1. A false ceiling panel frame, at least one side of this frame comprising, when viewed in cross section, a top wall and a side wall, wherein the side wall includes an approximately vertical top section and a bottom section, the top section and the bottom section forming an obtuse angle in the external face of the panel frame, wherein the frame further comprises:

a horizontal bearing surface in the bottom section of the side wall;

a stiffening wall; and an internal flange;

wherein the stiffening wall links the bearing surface and the internal flange.

2. The panel frame as claimed in claim 1, wherein the width of the horizontal bearing surface, the size of the bottom section of the side wall and said obtuse angle are chosen such that the horizontal bearing surface extends towards the exterior of said frame with respect to the vertical plane of said top section of the side wall.

3. The panel frame as claimed in claim 1, wherein said side of the frame includes an assembly slot with its opening facing the interior of the frame.

4. The panel frame as claimed in claim 3, further comprising a first assembly slot extending along a flange internal to the side of the frame, this internal flange being approximately vertical.

5. The panel frame as claimed in claim 4, further comprising an internal wall, this internal wall forming a box with the top wall, the side wall and said internal flange.

6. The panel frame as claimed in claim 5, wherein said internal wall features at least a section assembly slot, this second assembly slot being suitable for locating a splice plate or an angle cleat for assembling two adjacent sides of the frame.

7. The panel frame as claimed in claim 5, wherein the stiffening wall forms a box with the internal wall and the side wall.

8. The panel frame as claimed in claim 1, wherein said side of the frame includes, when viewed in cross section, an approximately horizontal top wall, said obtuse angle being between 120 and 179 degrees.

9. The panel frame as claimed in claim 8, wherein the width of the horizontal bearing surface is between 1 millimeter and 10 millimeters.

10. A false ceiling panel comprising a frame, as presented in claim 1, and a fabric, into which the frame is inserted, thereby defining a bottom band of stretched fabric and a top band of stretched fabric.

11. The false ceiling panel as claimed in claim 10, further comprising an acoustic and/or thermal insulation insert, this insert being installed to bear freely on the angles distant from the bottom fabric band.

12. A false ceiling comprising a panel as presented in claim 10, this panel being mounted on an inverted T-shaped support.

* * * * *